US009020376B2

(12) United States Patent
Ito et al.

(10) Patent No.: US 9,020,376 B2
(45) Date of Patent: Apr. 28, 2015

(54) IMAGE FORMING APPARATUS CAPABLE OF PROVIDING STABLE IMAGE QUALITY

(75) Inventors: Megumi Ito, Tokyo (JP); Jun Hirabayashi, Yokohama (JP)

(73) Assignee: Canon Kabushiki Kaisha (JP)

( * ) Notice: Subject to any disclaimer, the term of this patent is extended or adjusted under 35 U.S.C. 154(b) by 659 days.

(21) Appl. No.: 13/230,250

(22) Filed: Sep. 12, 2011

(65) Prior Publication Data

US 2012/0063796 A1 Mar. 15, 2012

(30) Foreign Application Priority Data

Sep. 14, 2010 (JP) ..... 2010-205641

(51) Int. Cl.
*G03G 15/08* (2006.01)
*G03G 15/00* (2006.01)

(52) U.S. Cl.
CPC ..... *G03G 15/5041* (2013.01)

(58) Field of Classification Search
USPC ..... 399/29, 49
See application file for complete search history.

(56) References Cited

U.S. PATENT DOCUMENTS

| | | | | |
|---|---|---|---|---|
| 7,480,475 | B2 | 1/2009 | Miyoshi et al. | |
| 8,611,768 | B2 | 12/2013 | Kubo et al. | |
| 2011/0164888 | A1* | 7/2011 | Kubo et al. | 399/27 |

FOREIGN PATENT DOCUMENTS

| | | | |
|---|---|---|---|
| JP | H04-343573 | A | 11/1992 |
| JP | 06-110328 | A | 4/1994 |
| JP | 2006-243328 | A | 9/2006 |
| JP | 2010-102317 | A | 5/2010 |
| WO | 2010/035432 | A1 | 4/2010 |

OTHER PUBLICATIONS

Kubo et al. (JP 2010-102317 A), May 2010, JPO Computer Translation.*

Notification of the First Office Action for corresponding CN 201110281483.3, mail date Dec. 4, 2013. English translation provided.

Japanese Office Action cited in Japanese counterpart application No. JP2010-205641, dated Apr. 15, 2014.

* cited by examiner

*Primary Examiner* — Erika J Villaluna

(74) *Attorney, Agent, or Firm* — Rossi, Kimms & McDowell LLP

(57) ABSTRACT

An image forming apparatus capable of making image quality more stable than in the prior art. An electrostatic latent image is formed on the surface of a photosensitive member based on an image signal. A developing device develops the electrostatic latent image on the photosensitive member by toner to thereby form a patch image. An optical sensor detects the density of the patch image. A toner charge amount is calculated from the density detected by the optical sensor, and a change in the toner charge amount is predicted based on a plurality of results of the calculation of the toner charge amount. The image forming apparatus generates a γLUT for use in correcting the relationship between the image signal and the density based on the predicted change in the toner charge amount.

8 Claims, 18 Drawing Sheets

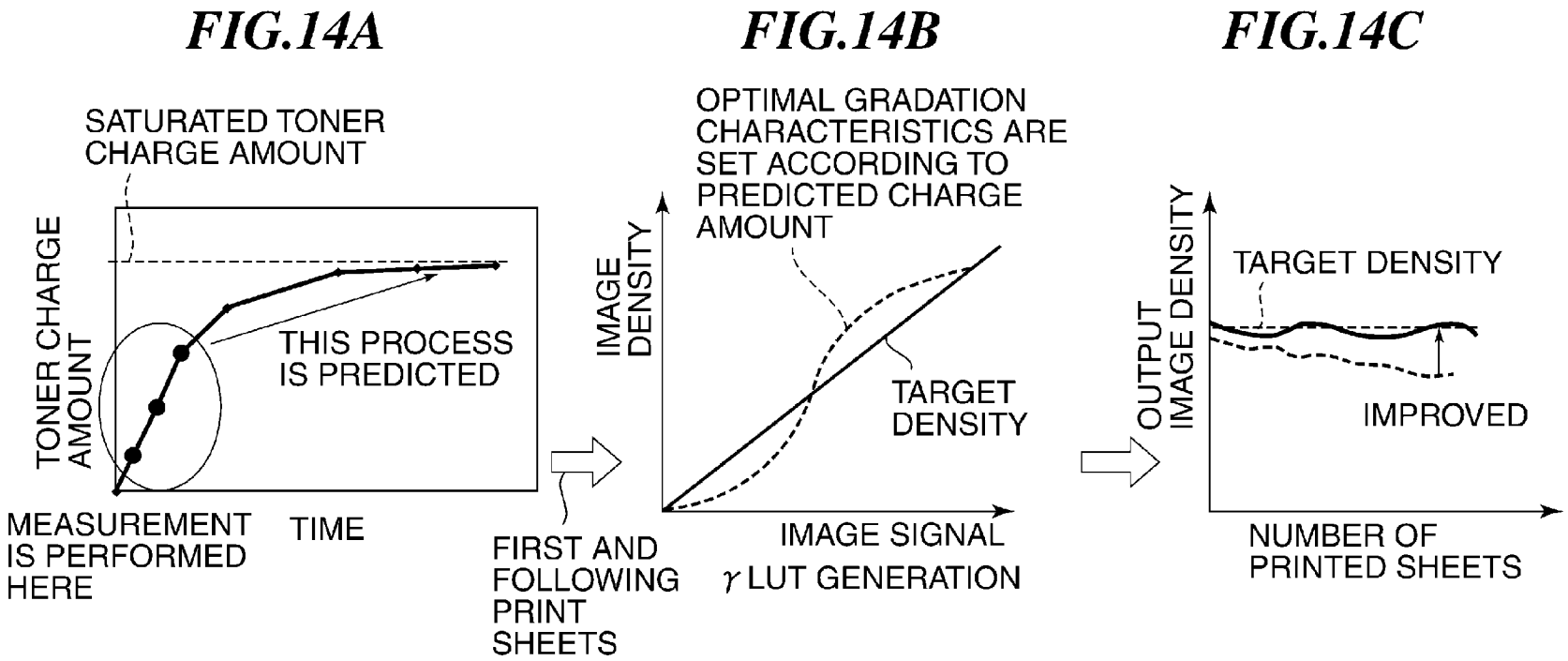
FIG.14A
SATURATED TONER CHARGE AMOUNT
THIS PROCESS IS PREDICTED
TONER CHARGE AMOUNT
TIME
MEASUREMENT IS PERFORMED HERE
FIRST AND FOLLOWING PRINT SHEETS
FIG.14B
OPTIMAL GRADATION CHARACTERISTICS ARE SET ACCORDING TO PREDICTED CHARGE AMOUNT
TARGET DENSITY
IMAGE DENSITY
IMAGE SIGNAL
γ LUT GENERATION
FIG.14C
TARGET DENSITY
IMPROVED
OUTPUT IMAGE DENSITY
NUMBER OF PRINTED SHEETS

IMAGE FORMING APPARATUS CAPABLE OF PROVIDING STABLE IMAGE QUALITY

BACKGROUND OF THE INVENTION

1. Field of the Invention

The present invention relates to an image forming apparatus using electrophotography.

2. Description of the Related Art

Roughly, image formation using electrophotography is performed through the following process: First, a photosensitive member as an image bearing member is charged by an electrostatic charger, and an invisible electrostatic latent image is formed on the surface of the charged photosensitive member by being irradiated with light by an exposure device, whereafter a toner image is generated by visualizing the invisible electrostatic latent image using colored toner particles as a developer. The so-called developing process for generating the toner image is realized by moving and placing the charged toner particles by electrostatic forces. Then, the toner image formed on the surface of the photosensitive member is transferred onto a print sheet by electrostatic forces directly or via a transfer member and is finally fixed on the print sheet by a fixing device.

In an apparatus configured to form an image by electrostatically attaching toner onto a photosensitive member, a change in the amount of charged toner (hereinafter referred to as "the toner charge amount") directly leads to changes in color hue and density. For example, the toner charge amount changes with time according to an amount of printing of characters and images, a toner replenishment rate, an environment, and so forth, and hence even in a case where the same image is continuously printed, color hue and density can differ between a first copy and a final one. To cope with this problem, it is important to accurately grasp a change in the toner charge amount, i.e. charge-development characteristics.

To improve stability of image quality (i.e. the quality of printing on print sheets or the like), there has been proposed a technique in which a predetermined gradation patch is formed before or after image formation or during image formation and a deviation of a formed gradation patch from a proper one to be formed is corrected. For example, after completion of warm-up of an image forming apparatus, a predetermined image pattern is formed on an image bearing member, and the density of the image pattern is detected. Then, the configuration of a circuit, such as a gamma correction circuit, for changing image forming conditions is changed to improve the stability of image quality (see e.g. Japanese Patent Laid-Open Publication No. H04-343573).

However, the conventional technique for improving the stability of image quality suffers from various problems. The problems will be described with reference to FIGS. 18A to 18D. FIGS. 18A to 18D are diagrams schematically showing charge-development characteristics of an image forming apparatus that forms images using electrophotography.

FIG. 18A schematically shows the relationship between time elapsed after the start of the image forming apparatus and the toner charge amount. When the image forming apparatus is started, a developing device starts operation (rotation), and the toner charge amount rises toward a saturated charge amount. Depending on timing in which charge characteristics (toner charge amount) are acquired during the rise in the toner charge amount, a difference (deviation) can occur between the toner charge amount at the time of acquisition of the charge characteristics and a toner charge amount at the time of actual printing. The difference (deviation) seriously influences image quality.

More specifically, as schematically illustrated in FIG. 18B, when a toner charge amount set for actual printing is high, the amount of toner particles attached onto an electrostatic latent image formed based on the obtained charge characteristics is reduced, which makes output image density (print density) low. On the other hand, when the actual toner charge amount is low, the amount of toner particles attached onto an electrostatic latent image formed based on the obtained charge characteristics is increased, which makes the output image density high. Note that a vertical axis in FIG. 18B represents the surface potential of a photosensitive member, and "Vl" represents a light potential (potential in an exposed area), "Vcont" a developing contrast potential, "Vdev" a developing bias potential, "Vback" a fog removal potential, and "Vd" a dark potential.

As shown in FIG. 18C, when image forming conditions are set in a state where a difference (deviation) in toner charge amount is not corrected, control deviating from optimal gradation characteristics is performed, so that a density change from a target density is increased, which causes serious degradation of control stability. As a consequence, the difference between the target density and the output image density is increased with an increase in the number of print sheets as shown in FIG. 18D, which makes color very unstable.

SUMMARY OF THE INVENTION

The present invention provides an image forming apparatus which is capable of making image quality more stable than in the prior art.

In a first aspect of the present invention, there is provided an image forming apparatus comprising an image bearing member configured to have an electrostatic latent image formed on a surface thereof based on an image signal, a developing unit configured to develop the electrostatic latent image on the image bearing member by using toner to thereby form a patch image, a detection unit configured to detect a density of the patch image, a predicting unit configured to calculate a toner charge amount from the density detected by the detection unit and predict a change in the toner charge amount based on a plurality of results of the calculation of the toner charge amount, and a generation unit configured to form a gradation correction table for use in correcting a relationship between the image signal and the density based on the change in the toner charge amount, predicted by the predicting unit.

In a second aspect of the present invention, there is provided an image forming apparatus comprising an image bearing member configured to have an electrostatic latent image formed on a surface thereof based on an image signal, an exposure unit configured to form the electrostatic latent image on the surface of the image bearing member by performing exposure on the image bearing member based on the image signal, a developing unit configured to develop the electrostatic latent image formed on the image bearing member by using developer to thereby form a toner image, a transfer unit configured to transfer the toner image onto a print sheet, a fixing unit configured to fix the toner image transferred onto the print sheet, and a detection unit configured to detect an image density of a toner image of a patch image before a rising time constant of toner charge amount has elapsed after the developing unit started operation or before internal temperature of the developing unit has sharply risen due to start of the fixing unit after the fixing unit is started.

According to the present invention, it is possible to properly estimate the toner charge amount for actual printing based on the acquired charge-development characteristics.

Further features of the present invention will become apparent from the following description of exemplary embodiments with reference to the attached drawings.

BRIEF DESCRIPTION OF THE DRAWINGS

FIGS. 14A to 14C are diagrams schematically organizing features of the first embodiment.

DESCRIPTION OF THE EMBODIMENTS

The present invention will now be described in detail below with reference to the accompanying drawings showing embodiments thereof. Specifically, the present invention is applicable to image forming apparatuses, such as various printers and copying machines, and the component elements of an image forming apparatus of the present invention are identical to those of the conventional image forming apparatus except that the former includes units and sequences for acquisition and control of charge-development characteristics, described hereinafter, as a central component element of the present invention. Therefore, similarly to the conventional image forming apparatus, the image forming apparatus of the present invention, described in the following, is configured to scan an original image (image on an original), perform image processing, and print out image data onto a print sheet or the like. The process is also basically identical to that performed by the conventional image forming apparatus.

Figure 1:
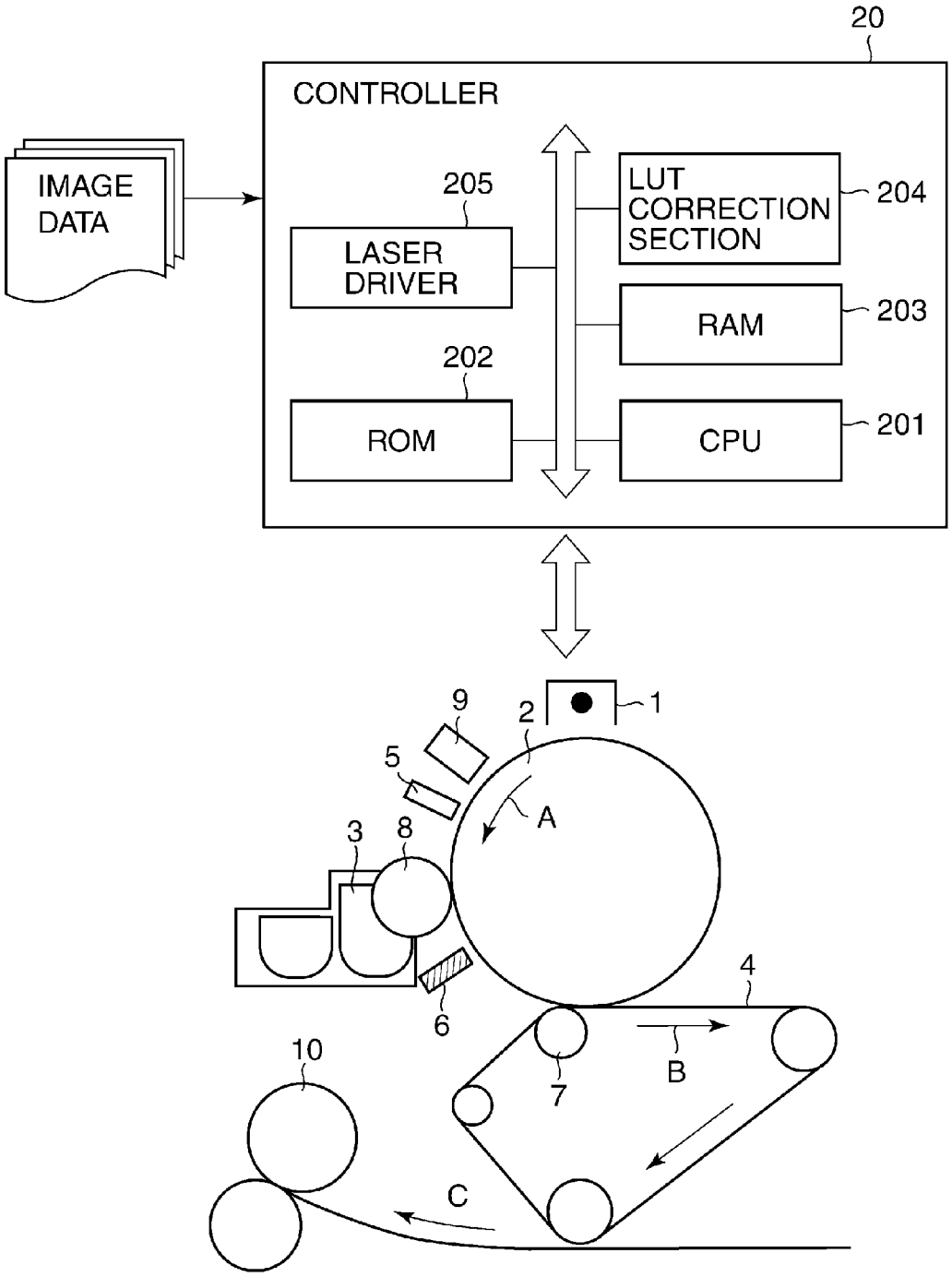
FIG. 1 is a schematic view of an image forming apparatus according to a first embodiment of the present invention.

FIG. 1 is a schematic view of the image forming apparatus according to a first embodiment of the present invention. FIG. 1 basically provides schematic illustration of component parts associated with a process of forming an electrostatic latent image on a photosensitive member as an image bearing member, then forming a toner image by attaching toner onto the electrostatic latent image, and transferring the toner image onto a print sheet or the like.

The operation of the image forming apparatus is controlled by a controller 20. In the controller 20, a CPU 201 loads a program stored in a ROM 202 into a RAM 203 and generates control signals by executing the program. Then, predetermined component elements of the image forming apparatus are operated and controlled according to the control signals from the controller 20, whereby a series of processes by the image forming apparatus are realized. Note that in the present embodiment, a LUT correction section 204 for γ-LUT correction, described hereinafter, is provided as a component element independent of the CPU 201 as shown in FIG. 1. In the following, component elements, appearing in FIG. 1, of the image forming apparatus will be described according to steps (a latent image forming step, a developing step (toner image forming step), a transfer step and fixing step, and a gradation correction step) of an image forming process executed by the image forming apparatus.

[Latent Image Forming Step] In the image forming apparatus, an original image is read by a scanner, not shown, and a printing operation is started based on acquired image data. A photosensitive member (photosensitive drum) 2 as an image bearing member is driven for rotation in a direction indicated by an arrow A such that it is uniformly charged by an electrostatic charger 1. Then, the photosensitive member 2 is irradiated with light by an exposure device 9 based on an image signal. As a consequence, an invisible electrostatic latent image is formed on the surface of the photosensitive member 2. Note that reference numeral "5" appearing in FIG. 1 denotes a surface potential sensor. The surface potential sensor 5 is used to measure the surface potential of the photosensitive member 2, as described hereinafter.

[Developing Step (Toner Image Forming Step)] The electrostatic latent image formed on the surface of the photosensitive member 2 is developed into a visible toner image by a developing device 3. The developing device 3 generates the toner image e.g. by a developing method using a two-component developer formed by mixing magnetic carrier particles and non-magnetic toner particles at a predetermined ratio. The developer containing toner particles electrostatically charged by friction is held on a developing sleeve 8 and is conveyed to a development nip where the developing sleeve 8 and the photosensitive member 2 are close to each other.

The toner particles conveyed to the development nip are attached onto the electrostatic latent image by a developing bias applied to the developing sleeve 8 such that the electrostatic latent image is electrostatically filled with electric charge of the toner particles. Thus, the electrostatic latent image is developed, whereby the toner image is generated. The amount of toner particles to be attached onto the electrostatic latent image (i.e. a development toner amount) depends on a charge amount per unit weight of toner particles, and therefore when a change occurs in the charge amount of toner particles e.g. due to change in temperature and humidity or aging change in material characteristics, the development toner amount changes. Specifically, as the charge amount per unit weight of the toner particles is reduced, the amount of developing toner increases so as to fill the electrostatic latent image, which makes the output image density (print density) higher. On the other hand, when the charge amount per unit weight of the toner particles is increased, it is possible to fill the electrostatic latent image with a reduced amount of developing toner, and therefore the amount of developing toner is reduced, which makes the output image density lower.

[Transfer Step and Fixing Step] When a transfer voltage is applied to a transfer roller 7 opposed to the photosensitive member 2 via an intermediate transfer belt 4, the toner image formed on the photosensitive member 2 is transferred from the surface of the photosensitive member 2 onto the surface of the intermediate transfer belt 4 by electrostatic forces. The toner image transferred onto the surface of the intermediate transfer belt 4 is conveyed in a direction of rotation of the intermediate transfer belt 4, i.e. a direction indicated by an arrow B, and is transferred onto a medium, such as a print sheet, conveyed in a direction indicated by an arrow C. The print sheet or the like having the toner image transferred thereon is conveyed to a fixing device 10, where the toner image is fixed on the print sheet or the like by heat and pressure.

Figure 2A:
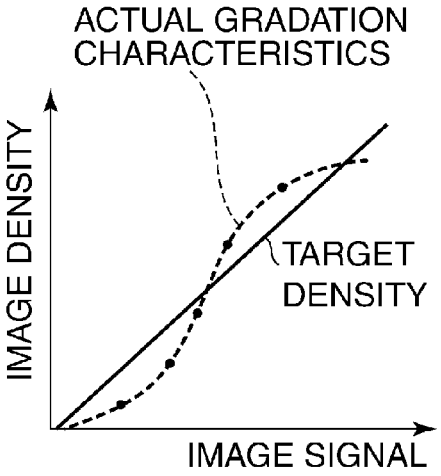
FIGS. 2A and 2B are graphs showing the relationship between an image signal and image density.
Figure 2B:
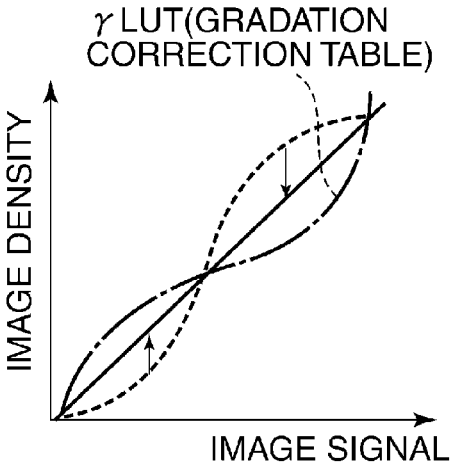

[Gradation Correction Step] FIGS. 2A and 2B are graphs showing the relationship between an image signal and image density. In general, multi-gradation patch images are output after the start of the image forming apparatus, and the density of each image is measured, whereby a graph (γ curve) showing the relationship between an image signal and image density is generated ("actual gradation characteristics" in FIG. 2A). Then, the γ curve is inversely converted such that the γ curve becomes equal to a straight line representative of a target density, whereby a gradation correction table (γLUT) showing the relationship is generated (see FIG. 2B). Note that the γLUT is stored in a storage medium, such as a nonvolatile memory.

After generation of the γLUT, image data to be printed is subjected to γ conversion using the γLUT, whereby a desired output image density is obtained. However, the γLUT can become unreliable during printing e.g. due to an environmental change or a change in materials, which makes it impossible to obtain the desired output image density.

To avoid this, control for correcting the γLUT is performed as control for correcting gradation. Electrostatic latent images of respective predetermined patch images are periodically formed on the surface of the photosensitive drum 2 in a non-printing area (e.g. between print sheets), and after development, the image density of each toner image (image portion) formed on the surface of the photosensitive drum 2 is detected. Specifically, the image density is detected by measuring a reflected light amount using an optical sensor 6 (see FIG. 1). The optical sensor 6 is implemented e.g. by a reflective optical sensor configured to irradiate a toner image with infrared light at an incident angle of 45 degrees and receive light reflected at a reflection angle of 45 degrees.

Figure 3:
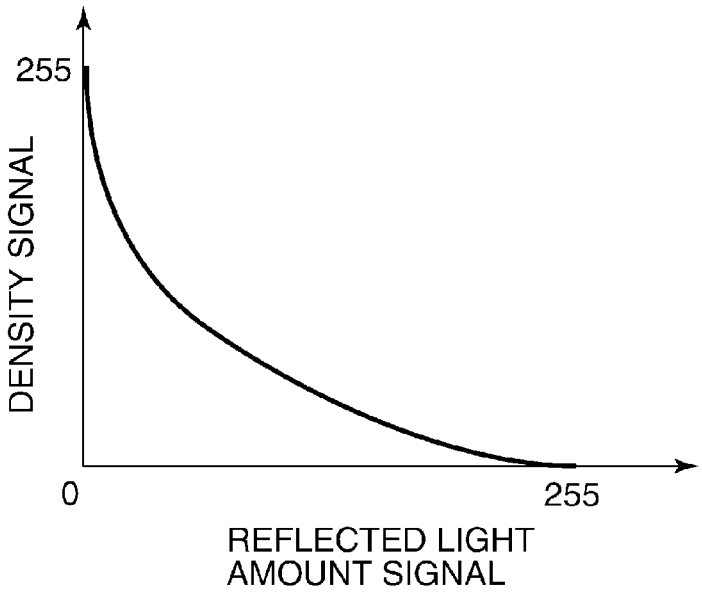
FIG. 3 is a graph showing the relationship between a reflected light amount signal and a density signal.

FIG. 3 is a graph showing the relationship between a reflected light amount signal and a density signal. In the present graph, the number of gradation levels is 256. The density signal (density value) is obtained from the graph shown in FIG. 3, and the γLUT is corrected based on the difference between the density value and a target density. Note that the FIG. 3 graph shows a general correspondence between the reflected light amount signal and the density signal. Therefore, e.g. when the relationship (dependence) between the reflected light amount signal and the density signal differs from color to color, graphs may be prepared in association with respective colors so as to obtain a density value on a color-by-color basis.

In the conventional image forming apparatus, a first γLUT is generated assuming that the toner charge amount has reached the saturated toner charge amount. However, if the toner charge amount has not actually reached the saturated toner charge amount and the toner charge amount increases during printing, deviation from a desired output image density occurs. To solve this problem, in the image forming apparatus according to the present invention, gradations are corrected based on charge-development characteristics obtained based on the density values of patch images calculated after the start of the image forming apparatus as described in the following, whereby a desired output image density is obtained.

Figure 4A:
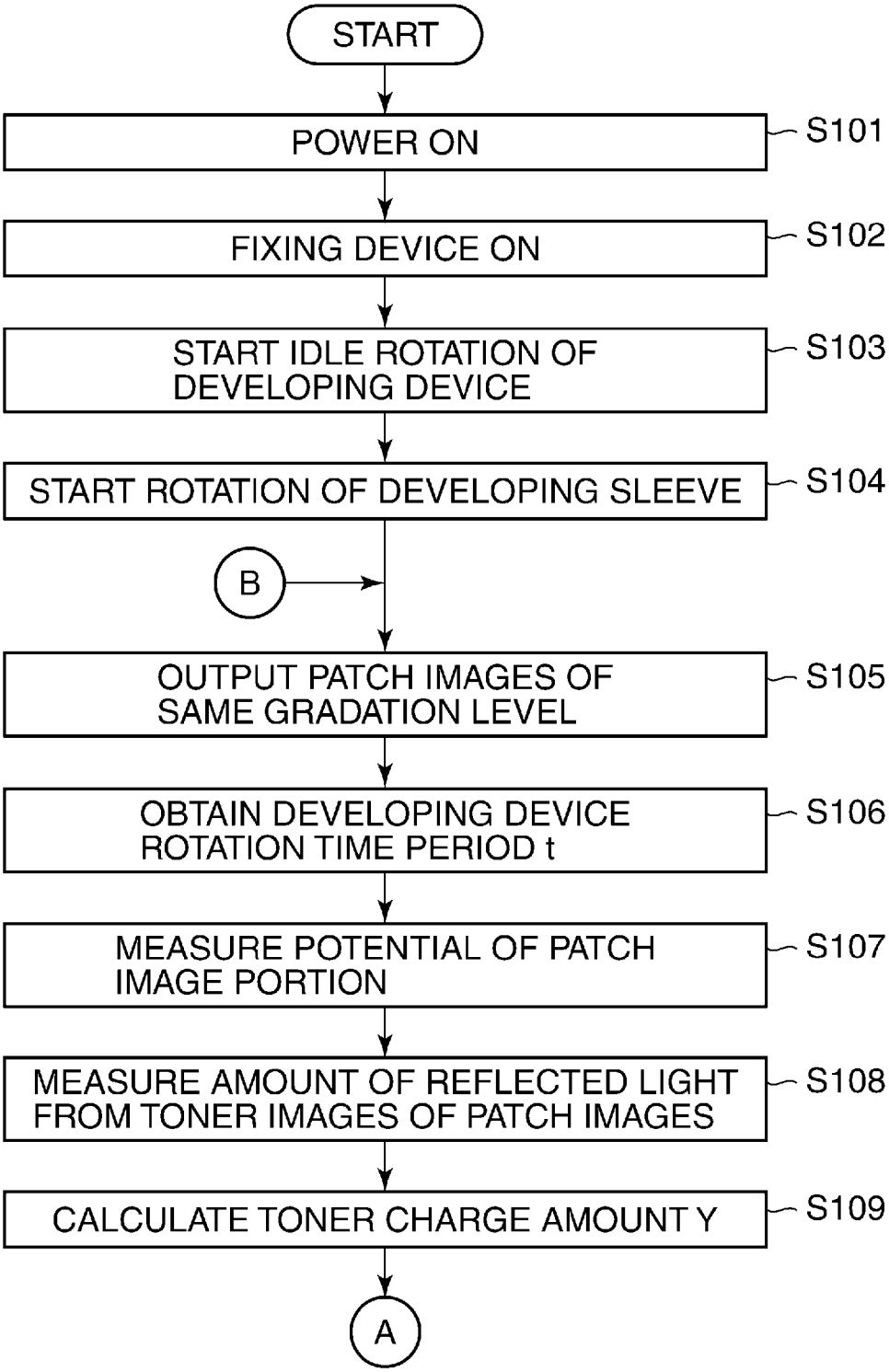
FIG. 4 is a flowchart of a process for acquiring rising characteristics of a toner charge amount, which is executed by the image forming apparatus according to the first embodiment.
Figure 4B:
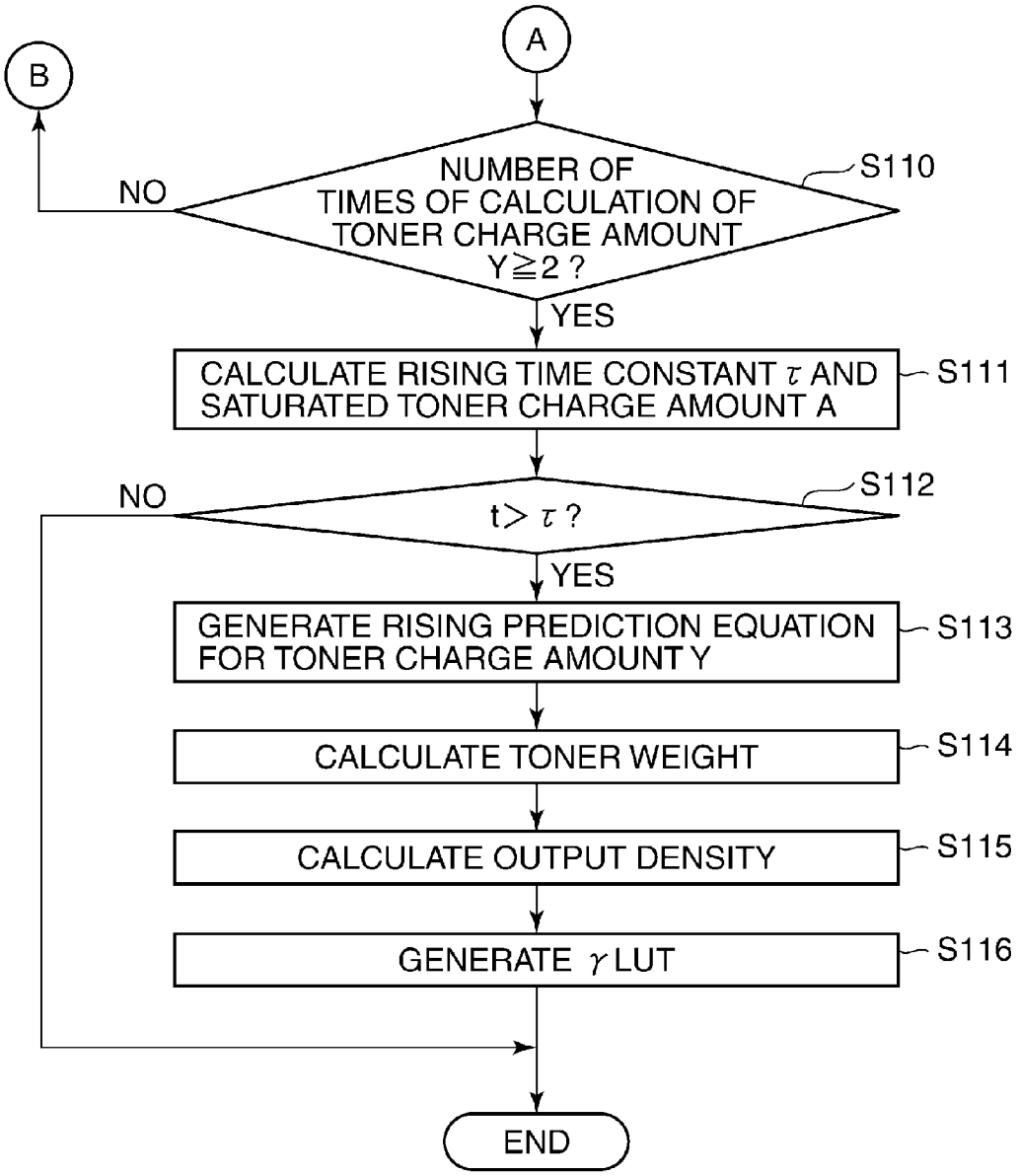

FIG. 4 is a flowchart of a process for acquiring rising characteristics of the toner charge amount, which is executed after the start of the image forming apparatus. When the power of the image forming apparatus is turned on (step S101), the power of the fixing device 10 is turned on (step S102), and idle rotation of the developing device 3 is started (step S103). Further, rotation of the developing sleeve 8 is started (step S104).

The charge-development characteristics of developer can be acquired basically by grasping temporal change in the toner charge amount. For the purpose of grasping the temporal change in the toner charge amount, first, a plurality of patch images of the same gradation level (the same image signal value) are output onto the surface of the photosensitive member 2 before a toner charge amount rising time constant τ elapses after the start of the rotation of the developing device 3, whereby electrostatic latent images of the respective patch images are formed (step S105).

A rotation time period t of the developing device 3 from the start of the idle rotation of the developing device 3 to the output of the patch images in the step S105 is obtained and stored in a memory (e.g. the RAM 203 of the controller 20) (step S106). Then, the potential of a patch image portion (i.e. an area where the electrostatic latent images of the respective patch images are formed) on the surface of the photosensitive member 2 is measured using the surface potential sensor 5 (step S107).

Figure 5:
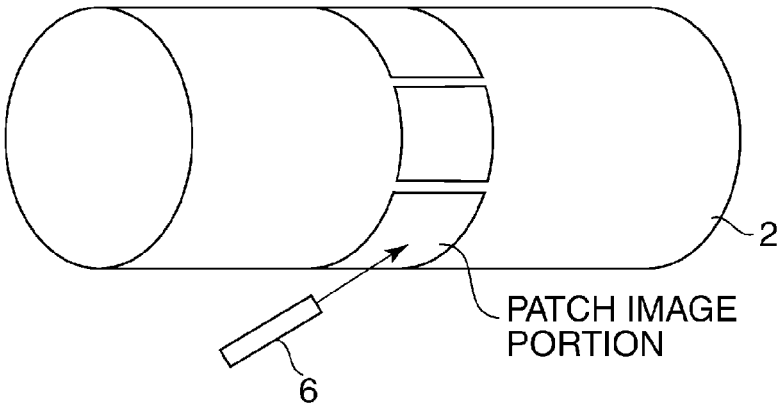
FIG. 5 is a schematic view useful in explaining processing executed in a step of the FIG. 4 process.

Then, the electrostatic latent images are developed into toner images, and the amount of reflected light from the toner images of the patch images formed on the surface of the photosensitive member 2 (from the area where toner images of the patch images are formed) is measured using the optical sensor 6 (step S108). FIG. 5 is a schematic view useful in explaining the processing executed in the step S108. In the present embodiment, the optical sensor 6 is implemented by a reflective optical sensor configured to irradiate a toner image with infrared light at an incident angle of 45 degrees and receive light reflected at a reflection angle of 45 degrees, as mentioned hereinbefore, but this is not limitative.

A toner charge amount Y is calculated using a potential V measured in the step S107 and a density value D converted from a reflected light amount measured in the step S108 (step S109) by the following equation (1):

$$Y=aV/D \tag{1}$$

wherein "a" represents a coefficient determined by a toner type, characteristics of the developing device 3, etc.

Figure 6:
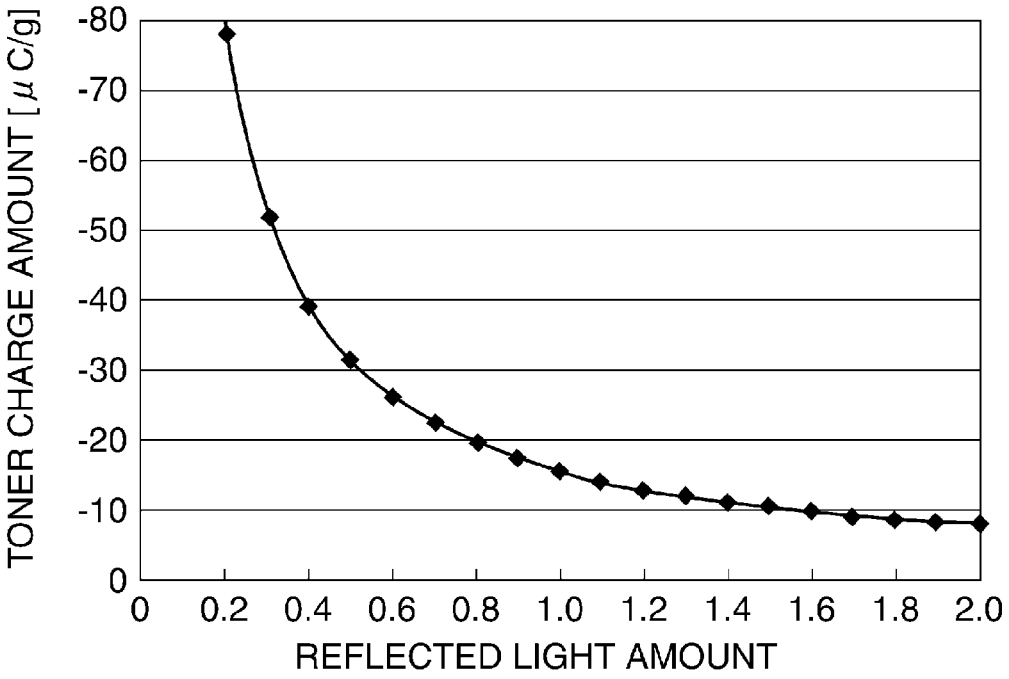
FIG. 6 is a graph showing the relationship between a reflected light amount and the toner charge amount based on data thereof prepared in advance.

Note that data indicative of the relationship between the reflected light amount and the toner charge amount may be provided in advance and the toner charge amount may be calculated from the reflected light amount measured in the step S108 by using the data. FIG. 6 is a graph showing the relationship between the reflected light amount and the toner charge amount based on data thereof prepared in advance. For example, the following equation (2) can be determined from FIG. 6. When the reflected light amount I is equal to 0.8, it is possible to determine the toner charge amount Y as a value of −19.5 [μ C/g], using the following equation (2):

$$Y=-15.6I \tag{2}$$

Figure 7A:
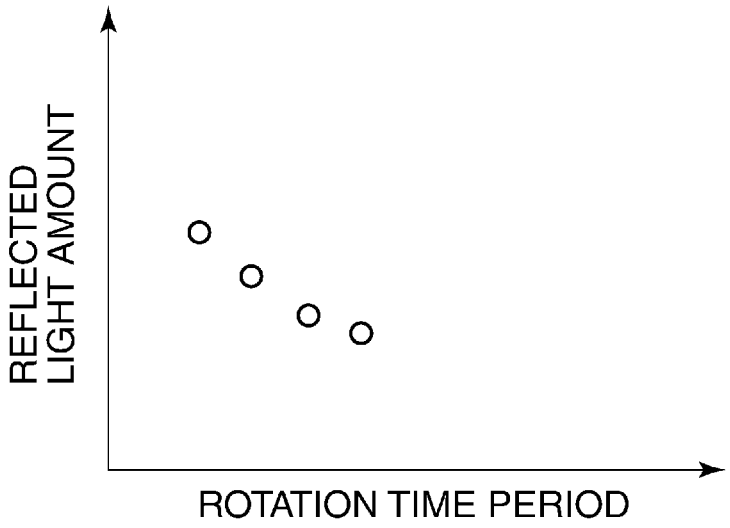
FIGS. 7A and 7B are graphs showing, respectively, the relationship between a reflected light amount measured in the step of the FIG. 4 process and a rotation time period of a developing device and the relationship between a toner charge amount calculated in another step of the FIG. 4 process and the rotation time period of the developing device.
Figure 7B:
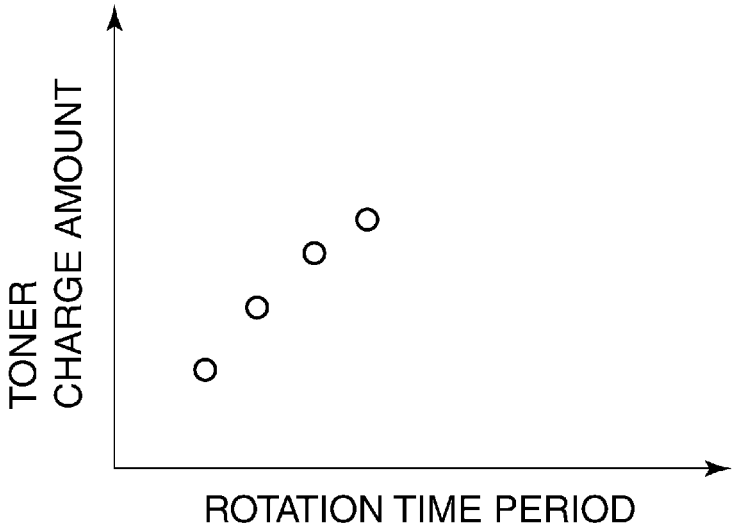

By executing the steps S105 to S107 and steps S108 and S109 while shifting the rotation time period t of the developing device 3, it is possible to obtain actual measurement data indicative of changes in the toner charge amount with respect to the rotation time period of the developing device 3 after the start of the image forming apparatus, as illustrated in FIGS. 7A and 7B. FIGS. 7A and 7B are graphs respectively showing the relationship between the reflected light amount measured in the step S108 and the rotation time period of the developing device 3 and the relationship between the toner charge amount calculated in the step S109 and the rotation time period of the developing device 3.

Figure 8:
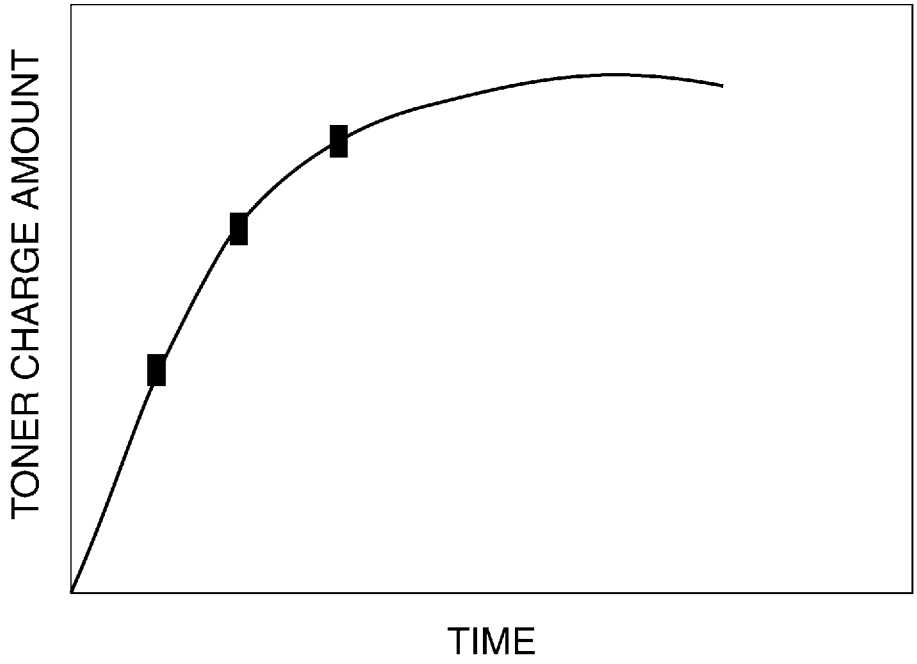
FIG. 8 is a graph showing a general relationship between the rotation time period of the developing device and the toner charge amount.

Incidentally, the toner charge amount increases as toner is charged by triboelectrifica-tion between toner particles and carrier particles. Therefore, if the developing device 3 is rotated without replenishment or consumption of the toner particles, the toner charge amount becomes large. FIG. 8 is a graph showing a general relationship between the rotation time period t of the developing device 3 and the toner charge amount. As shown in FIG. 8, the toner charge amount increases as the rotation time period t of the developing device 3 becomes longer, and becomes saturated at a fixed value. The curve of the toner charge amount Y at this time can generally be expressed by the following equation (3):

$$Y=A(1-e^{-pt}) \tag{3}$$

In the equation (3), "A" represents a saturated toner charge amount, and "p" represents the rising coefficient of the toner charge amount. The equation (3) contains the two unknowns "A" and "p" which cannot be determined directly in the steps 105 to S109, and therefore the steps 105 to S109 are executed while shifting the rotation time period t, so as to determine the unknowns "A" and "p".

Then, it is determined whether or not the toner charge amount has been calculated two or more times (step S110). If the toner charge amount has been calculated less than two times (NO to the step S110), the process returns to the step S105. If the toner charge amount has been calculated two or more times (YES to the step S110), the process proceeds to a step S111. In the step S111, simultaneous equations are solved using the rotation time period t and the toner charge amount Y determined by executing the steps 105 to S109 two or more times.

More specifically, the toner charge amount $Y_1$ corresponding to the rotation time period $t_1$ and the toner charge amount $Y_2$ corresponding to the rotation time period $t_2$ are obtained, and the obtained two values are substituted into the equation (3). Thus, simultaneous equations (4) are obtained, and the values "A" and "p" are calculated from the simultaneous equations (4), from the equations (5) and (6) (step S111):

$$Y_1=A(1-e^{-pt1}),Y_2=A(1e^{-pt2}) \tag{4}$$

$$P=\log((Y_1-Y_2)/(e^{-t2}-e^{-t1})) \tag{5}$$

$$A=(1-e^{-pt1})/Y_1 \tag{6}$$

The reciprocal of the rising coefficient p is equal to the rising time constant τ of the toner charge amount, and hence in the step S111, the rising coefficient p is calculated and the rising time constant τ of the toner charge amount is calculated from the following equation (7). The rising time constant τ of the toner charge amount represents a time period required for the toner charge amount to reach approximately 63% of the saturated toner charge amount.

$$\tau=1/p \tag{7}$$

Figure 9:
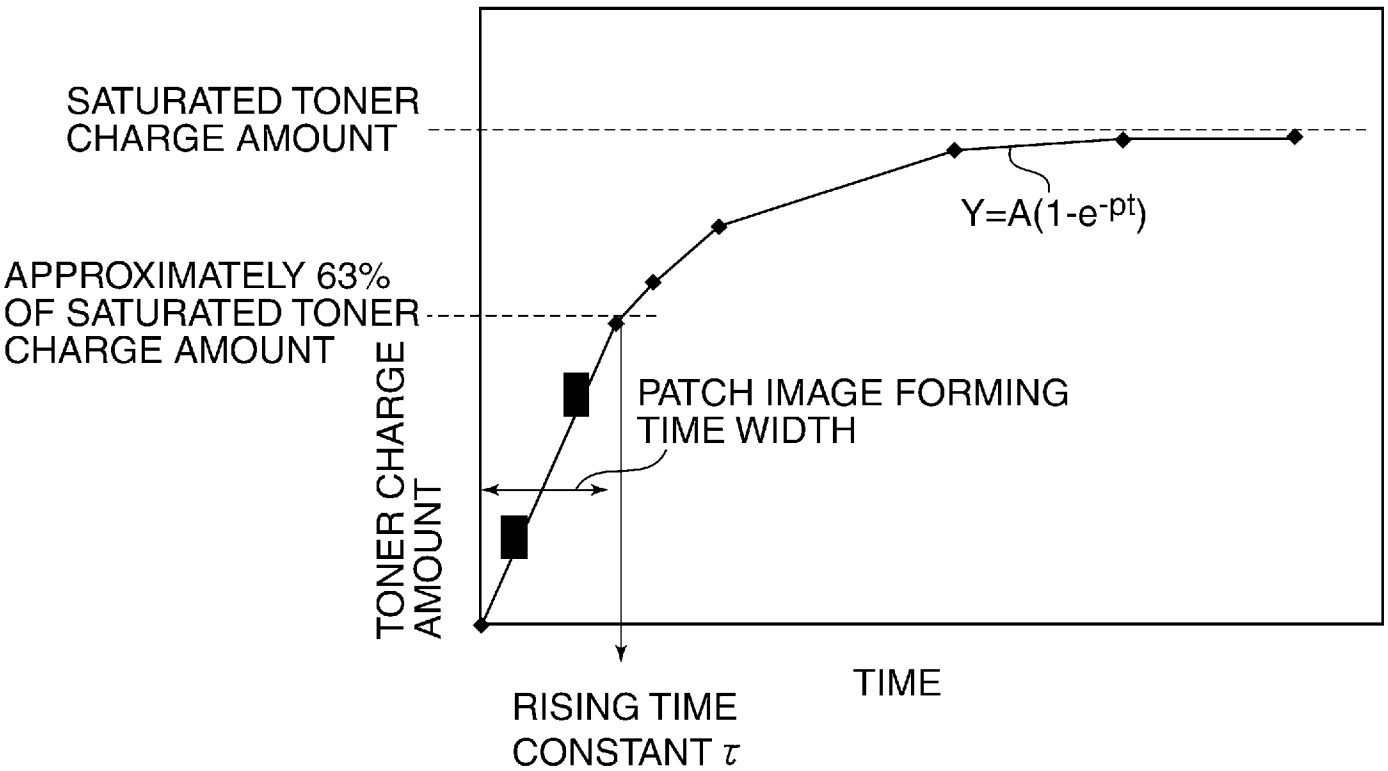
FIG. 9 is a graph showing the relationship between a rotation time period of the developing device and the toner charge amount, which are obtained in steps of the FIG. 4 process.

By executing the steps S105 to S111, it is possible to obtain a FIG. 9 graph showing the relationship between the rotation time period t of the developing device 3 and the toner charge amount Y. In the present embodiment, the number of times of calculation of the toner charge amount is set to twice, but as the number of times of calculation is increased, the relationship between the rotation time period t and the toner charge amount Y can be determined more accurately.

Note that the equation (3) may be replaced by the following equation (8), i.e. an equation representing the amount of change in the toner charge amount per unit time of the rotation time period of the developing device 3.

$$\beta_n=\alpha(Y_n-Y_{n+1})/(t_n-t_{n+1})$$

$$[n\text{: natural number}] \tag{8}$$

wherein "α" represents a correction coefficient set in advance.

Figure 10:
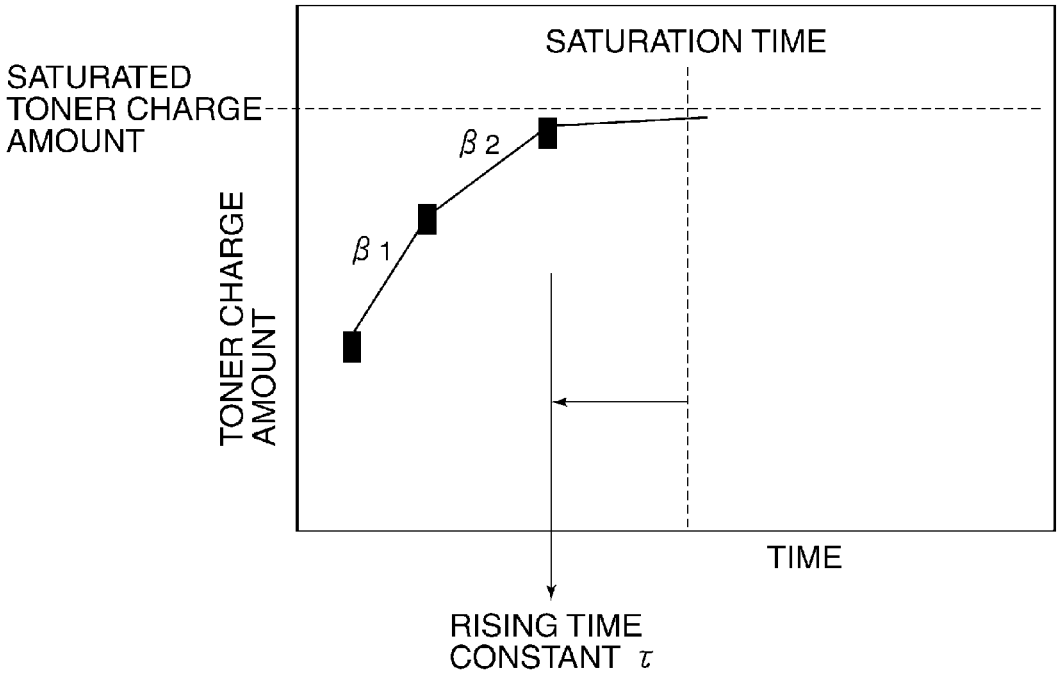
FIG. 10 is a schematic diagram useful in explaining a process for calculating a saturated toner charge amount and a rising coefficient, using an equation representing the rate of change of the toner charge amount per unit time of the rotation time period of the developing device.

FIG. 10 is a schematic diagram useful in explaining a process for calculating the saturated toner charge amount A and the rising coefficient p using the equation (8). For example, first, gradients $\beta_1$ and $\beta_2$ are calculated and compared with each other. Gradients $\beta_n$ and $\beta_{n+1}$ adjacent to each other are compared while increasing the value of n, and the value of $Y_{n+1}$ obtained when the $\beta_n$ value becomes smallest is set as the saturated toner charge amount A. Then, 63% of a time period taken before the saturated toner charge amount A was reached is set as the toner charge amount rising time constant τ.

Next, the rotation time period t of the developing device 3 obtained in the step S106 and the toner charge amount rising time constant τ calculated in the step S111 are compared with each other, whereby it is determined whether or not the relationship of "t>τ" is satisfied (step S112).

If the relationship of "t>τ" is not satisfied (NO to the step S112), which means that the time period for calculating a toner charge amount rising coefficient p and a saturated toner charge amount A and generating a γLUT is over, the present process is terminated, and the γLUT, the toner charge amount rising coefficient p, and the saturated toner charge amount A stored in the memory are used for execution of an image printing sequence. If the relationship of "t>τ" is satisfied (YES to the step S112), the process proceeds to a step S113. In the step S113, the toner charge amount rising coefficient p and the saturated toner charge amount A calculated in the step S111 are stored in a memory (e.g. the memory storing the γLUT) and are applied to the equation (3), whereby a rising prediction equation for predicting the toner charge amount Y at the time of start-up is formed. The rising prediction equation generated as above is used before execution of the image printing sequence (i.e. before printing an image on a print sheet) so as to predict a change in the toner charge amount.

Then, the toner charge amount Y is estimated using the rising prediction equation formed in the step S113, and a toner weight M per unit area is calculated from the relationship between the toner charge amount and the toner weight M per unit area, which is represented by the following equation (9) (step S114):

$$M=k/Y \tag{9}$$

wherein "k" represents a proportionality constant indicative of the relationship between the toner charge amount and the toner weight.

Figure 11:
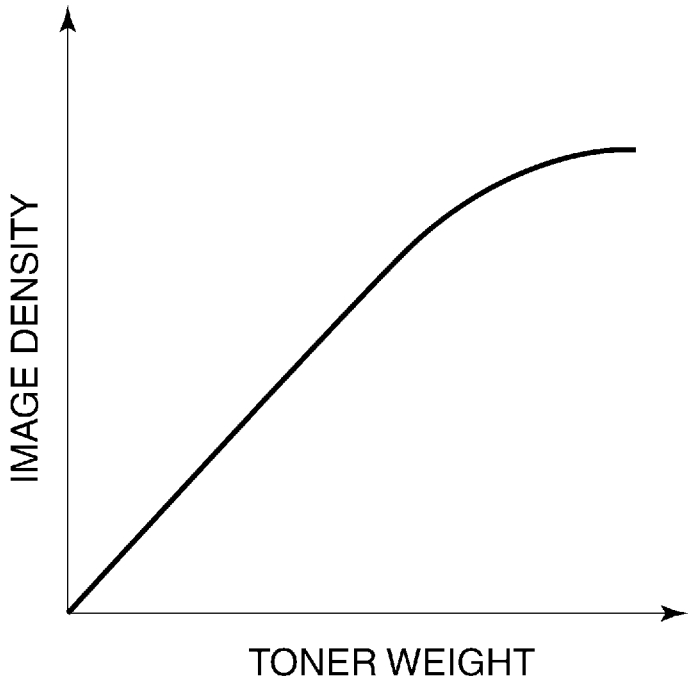
FIG. 11 is a graph showing the relationship between a toner weight per unit area and image density.

Further, an image density is calculated from the per-unit area toner weight obtained in the step S114, using the relationship, shown in FIG. 11, between per-unit area toner weight and image density (step S115). Then, a new γLUT is generated by correcting the γLUT stored in advance in the memory, using the image density calculated in the step S115, and is then stored in the memory (step S116).

During execution of the image printing sequence, the toner charge amount Y is predicted using the toner charge amount rising coefficient p and the saturated toner charge amount A, calculated as described above, and a γLUT is generated for each print sheet or the like by executing the steps S114 to S116, whereby printing is performed on the print sheet or the like. As described above, according to the present embodiment, the charge characteristics and development characteristics of developer are acquired during a time period before the other conditions change and a time period during which the charge characteristics and the development characteristics are reflected, so that it is possible to control output image density properly, starting from printing on a first print sheet.

Figure 12:
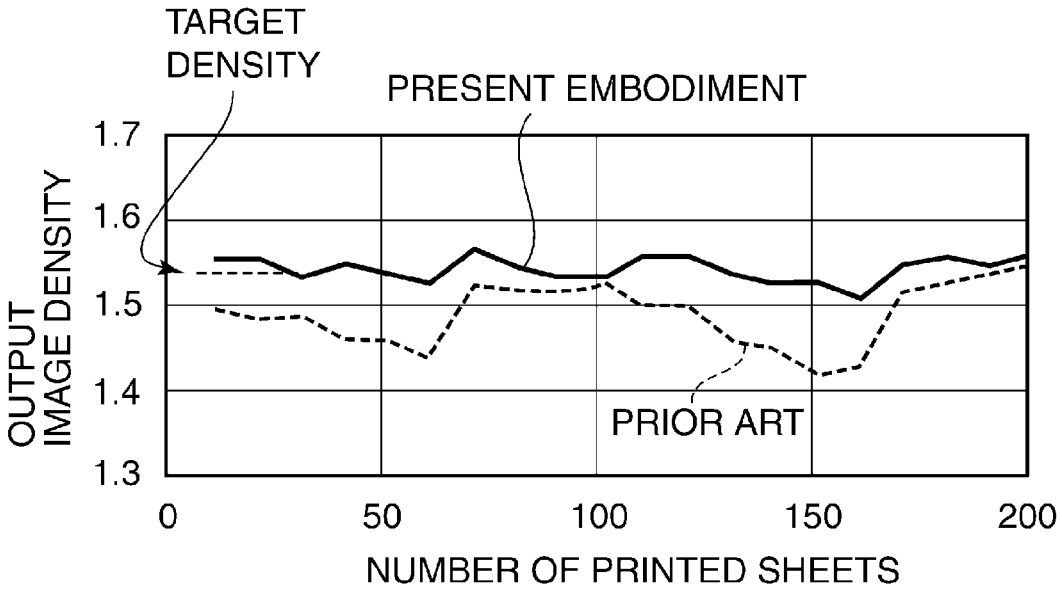
FIG. 12 is a diagram showing the number of printed print sheets and print density while comparing between the first embodiment and the prior art.

FIG. 12 is a diagram showing the number of printed print sheets and print density while comparing between the first embodiment and the prior art. In the prior art, the density of an actually printed image sharply changes as shown in FIG. 12. The reason for this will be explained with reference to FIG. 13.

Figure 13:
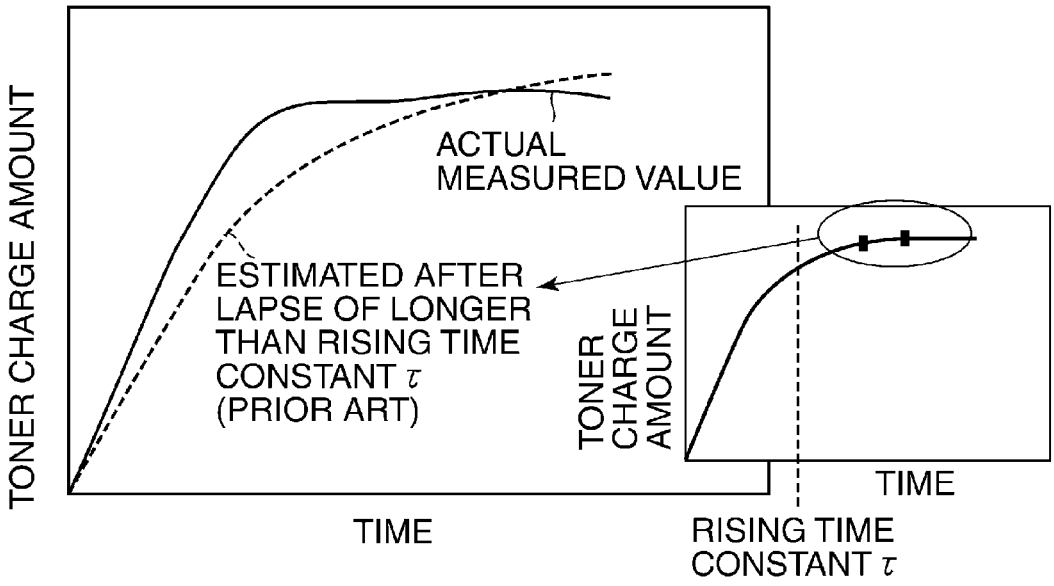
FIG. 13 is a diagram showing a comparison between actual toner charge amount rising characteristics of the image forming apparatus and toner charge amount rising characteristics of the same estimated by forming patch images after the lapse of a rising time constant.

FIG. 13 is a diagram showing a comparison between actual toner charge amount rising characteristics of the image forming apparatus and toner charge amount rising characteristics of the same estimated in the prior art by forming patch images after the lapse of the rising time constant τ. When the method of the prior art is used to estimate the toner charge amount, it is impossible to calculate the rising coefficient accurately. For this reason, the difference from the actual rising characteristics (actual measured value) appears as a large rising estimation curve (broken line), and the saturated toner charge amount also largely deviates from the actual measured value.

As described above, in the prior art, the error between the toner charge amount obtained immediately after the start of the image forming apparatus and the actual toner charge amount is large, and image forming conditions are set using a value with such a large error, so that the output image density largely deviates from a target density. In other words, in a case where patch images are formed after the lapse of the rising time constant τ so as to estimate the toner charge amount rising coefficient p and the saturated toner charge amount A included in the charge-development characteristics, a change in the toner charge amount (i.e. the rising characteristics) cannot be estimated accurately.

In contrast, it is understood that in the present embodiment, density deviation from the target density is reduced from the start of printing on a first print sheet, as shown in FIG. 12. FIGS. 14A to 14C are diagrams schematically organizing features of the present embodiment. As described hereinbefore, in the present embodiment, after the start of rotation of the developing device 3, the steps S105 to S116 are executed before the lapse of the toner charge amount rising time constant τ. This makes it possible to properly estimate values of the toner charge amount rising characteristics and the saturated toner charge amount as will be obtained after the lapse of the rising time constant τ. In other words, it is possible to properly predict the toner charge amount in a state in which the estimated toner charge amount rising characteristics substantially match actually measured toner charge amount rising characteristics. Thus, the toner charge amount can be properly estimated, so that even when the toner charge amount has not reached the saturated toner charge amount during a time period from the start of the image forming apparatus to actual image printing, it is possible to properly set image forming conditions while taking into account a change in the toner charge amount, from the start of printing on a first print sheet.

According to the present embodiment, since optimal image forming conditions can be set on a print sheet-by-print sheet basis as shown in FIG. 14B, color stability is greatly improved, which makes it possible to stably print a high-image quality image as shown in FIGS. 12 and 14C. Further, according to the present embodiment, since the saturated toner charge amount can be properly estimated based on the rising characteristics of the toner charge amount, before actual printing, it is possible to reduce time (idle rotation time of the developing device 3) required to saturate the toner charge amount, to thereby improve processing performance for printing on print sheets.

Next, an image forming apparatus according to a second embodiment of the present invention will be described. In the present embodiment, the image forming apparatus has the same hardware configuration as that in the first embodiment, and therefore detailed description thereof is omitted.

In the first embodiment, after the image forming apparatus is started and rotation of the developing sleeve 8 is started, a plurality of patch images of the gradation are formed before the lapse of the toner charge amount rising time constant τ, and the toner charge amount rising characteristics are determined within a time period reflecting the charge characteristics of developer. However, the toner charge amount rising time constant τ and the saturated toner charge amount A sometimes change e.g. due to an environmental change. For example, when the image forming apparatus is started and the fixing device 10 starts operation, an environmental change, such as a rise in ambient temperature of the fixing device 10, can occur to have influence on the toner charge amount rising characteristics. When environment within the developing device 3 changes during measurement of the toner charge amount rising characteristics, it is impossible to accurately determine the rising characteristics of the toner charge amount due to the influence of the environmental change.

Figure 15:
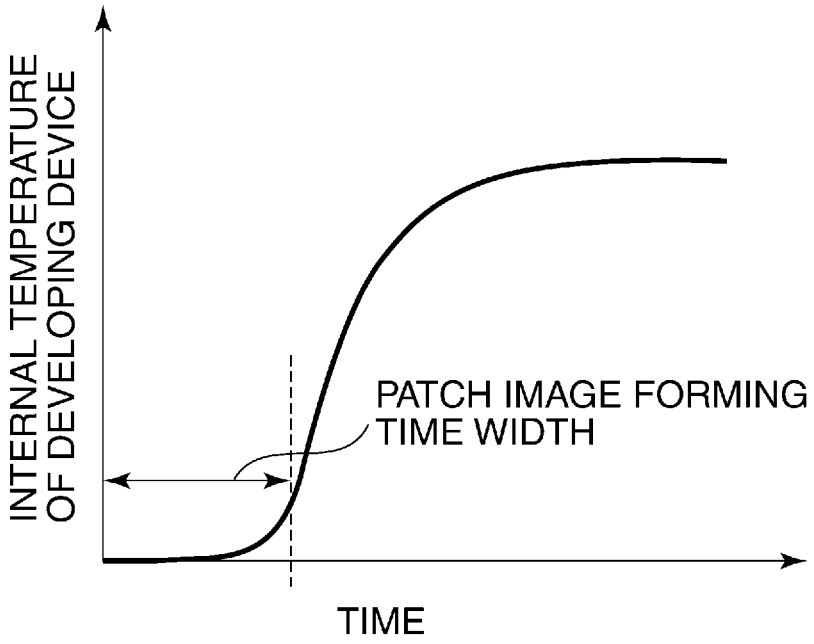
FIG. 15 is a diagram schematically showing a time period for obtaining toner charge amount rising characteristics in an image forming apparatus according to a second embodiment of the present invention.

To solve this problem, in the second embodiment of the present invention, after the start of the image forming apparatus, the toner charge amount rising characteristics are determined within a time period, during which the environment is stable, from the start of rotation of the developing sleeve 8 to immediately before the temperature in the developing device 3 sharply rises due to the start of the fixing device 10. FIG. 15 is a diagram schematically showing the time period for determining the toner charge amount rising characteristics in the second embodiment.

Figure 16A:
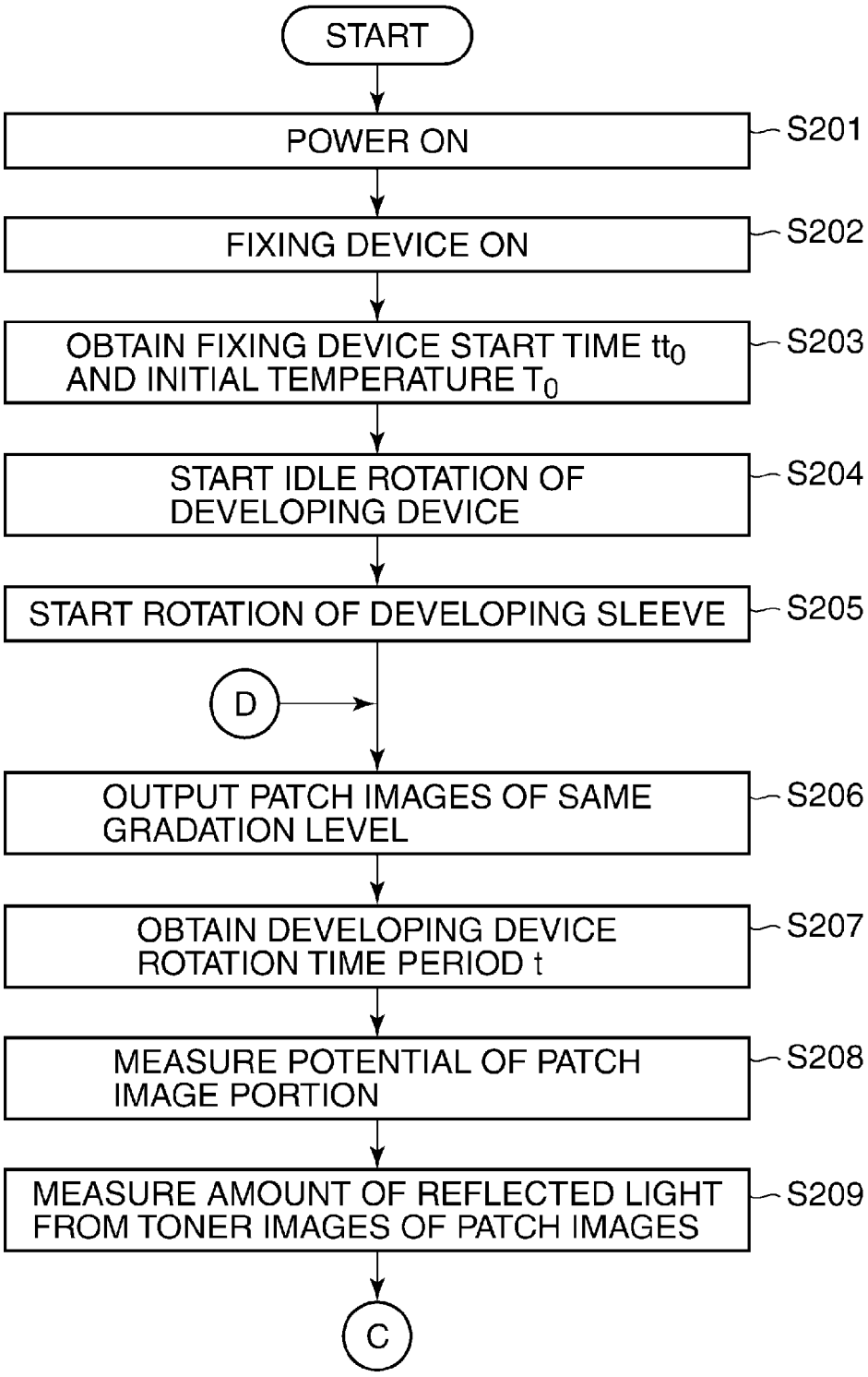
FIG. 16 is a flowchart of a process for acquiring the toner charge amount rising characteristics, which is executed by the image forming apparatus according to the second embodiment.
Figure 16B:
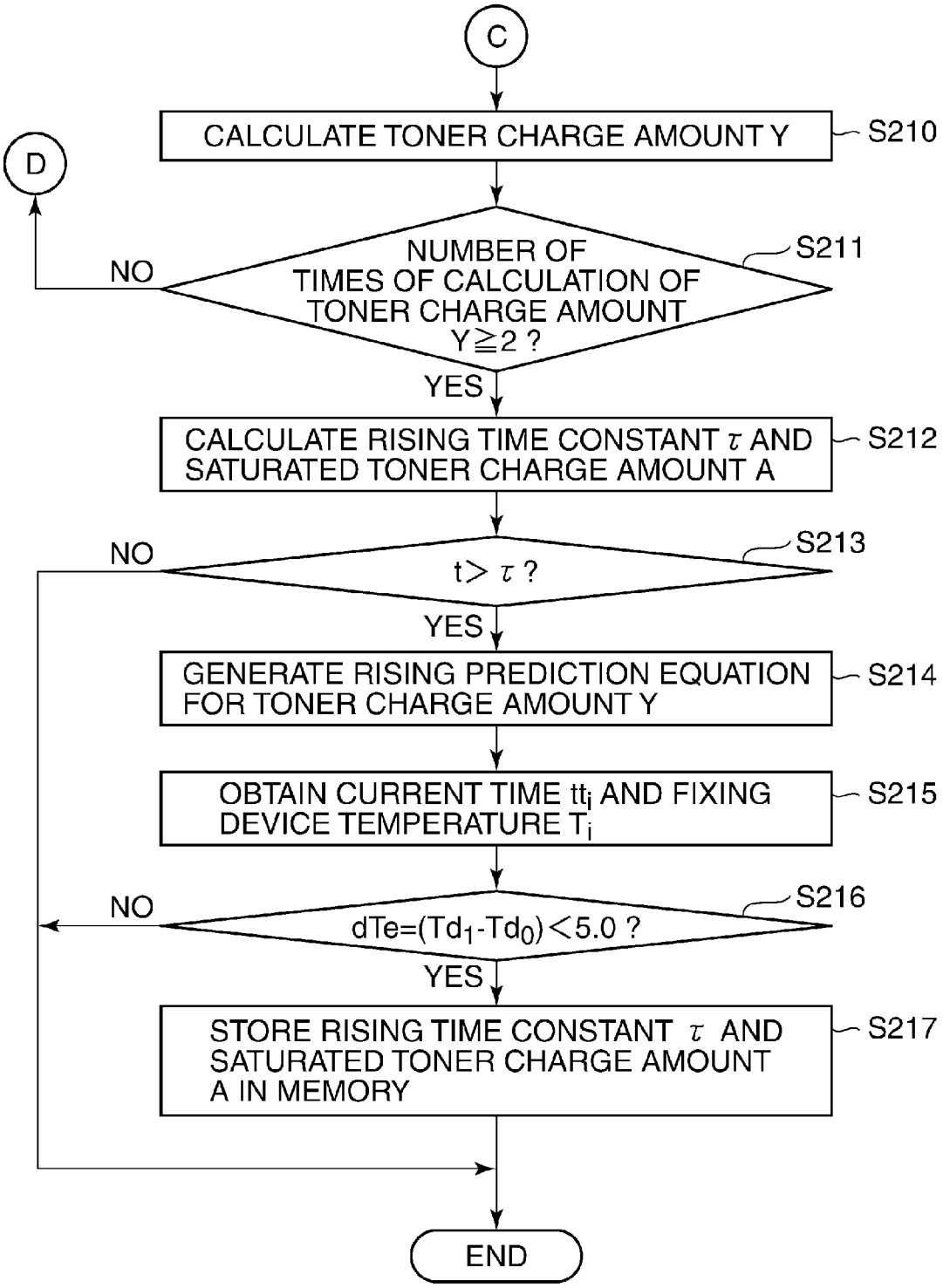

FIG. 16 is a flowchart of a process for determining the toner charge amount rising characteristics, which executed by the image forming apparatus according to the second embodiment. Further, steps in FIG. 15 identical to those described with reference to FIG. 4 in the first embodiment will be described just briefly, and detailed description thereof is omitted.

When the power of the image forming apparatus is turned on (step S201), the power of the fixing device 10 is automatically turned on (step S202). Then, a start time $tt_0$ when the power of the fixing device 10 was turned on and an initial temperature $T_0$ of the fixing device 10 at the start time $tt_0$ are obtained and stored in the memory (step S203).

Then, when idle rotation of the developing device 3 is started (step S204) and rotation of the developing sleeve 8 is started (step S205), a plurality of patch images of the same gradation level (the same image signal value) are output onto the surface of the photosensitive member 2, whereby electrostatic latent images are formed (step S206). Then, a rotation time period t of the developing device 3 from the start of the idle rotation of the developing device 3 to the output of the patch images in the step S206 is obtained and stored in the memory (step S207). Then, the potential of the patch image portion on the surface of the photosensitive member 2 is measured using the surface potential sensor 5 (step S208). Further, the electrostatic latent images are developed into toner images, and the amount of reflected light from the toner images of the patch images formed on the surface of the photosensitive member 2 is measured using the optical sensor 6 (step S209).

Then, a toner charge amount Y is calculated using the potential V measured in the step S208 and a density value D converted from the reflected light amount obtained in the step S209 (step S210). Next, it is determined whether or not the toner charge amount has been calculated two or more times (step S211). If the toner charge amount has been calculated less than two times (NO to the step S211), the process returns to the step S206. If the toner charge amount has been calculated two or more times (YES to the step S211), the process proceeds to a step S212. In the step S212, a saturated toner charge amount A and a toner charge amount rising coefficient p are calculated based on the rotation time period t and the toner charge amount Y determined by executing the steps S206 to S210, and a toner charge amount rising time constant τ is calculated using the saturated toner charge amount A and toner charge amount rising coefficient p thus calculated.

Next, the rotation time period t of the developing device 3 obtained in the step S207 and the toner charge amount rising time constant τ calculated in the step S212 are compared with each other, whereby it is determined whether or not the relationship of "t>ρ" is satisfied (step S213). If the relationship of "t>τ" is not satisfied (NO to the step S213), the present process is terminated, and the toner charge amount rising time constant τ Land the saturated toner charge amount A stored in the memory are used. If the relationship of "t>τ" is satisfied (YES to the step S213), the process proceeds to a step S214, wherein a rising prediction equation for predicting the toner charge amount Y at the time of start-up is formed. Note that the steps S201, S202, and S204 to S214 correspond to the respective steps S101, S102, and S103 to S113 described with reference to FIG. 4.

After execution of the step S214, a current time $tt_i$ and a current temperature $T_i$ of the fixing device 10 are obtained (step S215). The values obtained in the step S215 and the start time $tt_0$ and the temperature $T_0$ of the fixing device 10 stored in the memory are used to calculate a temperature change rate dTe with respect to time. Note that a conversion table for use in calculating the internal temperature of the developing device 3 with respect to rise in the temperature of the fixing device 10 has been formed in advance by preparing an environment table and measuring the internal temperature of the developing device 3 e.g. through experiment, and is stored in a memory (e.g. the ROM 202 of the controller 20).

The initial temperature $T_0$ obtained in the step S203 and the current temperature $T_i$ obtained in the step S215 are converted to respective internal temperatures $Td_0$ and $Td_i$, using the conversion table, and the temperature change rate dTe of the internal temperature of the developing device 3 is calculated by the following equation (10):

$$dTe=(Td_i-Td_0) \tag{10}$$

Note that the temperature change rate dTe may be calculated based on data which was obtained in advance by measuring the change characteristics of the internal temperature of the developing device 3 e.g. through experiment after the turn-on of the developing device 3, and is stored in a memory (e.g. the ROM 202 of the controller 20) in a tabulated form. Alternatively, a temperature and humidity sensor or the like may be provided in the developing device 3 for directly measuring the temperature change rate dTe, and a value thus obtained by the measurement may be used.

In a step S216, it is further determined whether or not the obtained temperature change rate dTe is in the relationship of "dTe<5.0". If "dTe<5.0" holds (YES to the step S216), the toner charge amount rising time constant τ and the saturated toner charge amount A calculated in the step S212 are stored in the memory (step S217), followed by terminating the present process. On the other hand, if "dTe 5.0" holds (NO to the step S216), the present process is terminated, so that the toner charge amount rising time constant τ and the saturated toner charge amount A stored in the memory are used.

As described above, according to the second embodiment, the toner charge amount rising characteristics are estimated immediately after the start of the image forming apparatus, in the stable environment before the internal temperature of the developing device 3 rises due to the start of the fixing device 10. This makes it possible to calculate the toner charge amount rising time constant τ and the saturated toner charge amount A with high accuracy.

Next, an image forming apparatus according to a third embodiment of the present invention will be described. In the present embodiment, the image forming apparatus has the same hardware configuration as that in the first embodiment, and therefore detailed description thereof is omitted. In the first and second embodiments, gradation correction is performed using the γLUT. In contrast, in the third embodiment, gradation correction is performed by correcting the laser intensity of the exposure device 9 that performs exposure on the photosensitive member 2.

After the start of the image forming apparatus, if the toner charge amount has not reached the saturated toner charge amount before setting the initial value of the laser intensity of the exposure device 9 that performs exposure on the surface of the photosensitive member 2, it is impossible to cope with a change in the toner charge amount after actual printing is started, which results in deviation of the output image density of printed image from a target density. To avoid this inconvenience, in the third embodiment, the toner charge amount is predicted, and a setting of the laser intensity of the exposure device 9 is corrected according to the predicted toner charge amount.

First, for example, a toner charge amount $Y_i$ before the start of printing is predicted by a toner charge amount rising prediction equation using the toner charge amount rising coefficient p and the saturated toner charge amount A calculated following the steps S101 to S111 in the first embodiment. Then, a per-unit area toner weight $M_{es}$ associated with an input image signal corresponding to a maximum gradation level value of 255 is estimated from the predicted toner charge amount $Y_i$, using the following equation (11):

$$M_{es}=k/Y_i \tag{11}$$

wherein "k" represents a proportionality constant indicative of the relationship between the toner charge amount and the toner weight.

A laser intensity correction coefficient q is calculated from the toner weight $M_{es}$ thus estimated and a target per-unit area toner weight $M_{tar}$ stored in a memory (e.g. the ROM 202 of the controller 20) as a target value for the per-unit area toner weight $M_{es}$ associated with the input image signal corresponding to the maximum gradation level value of 255, using the following equation (12):

$$q=M_{tar}/M_{es} \tag{12}$$

The CPU 201 of the controller 20 multiplies the input signal by the correction coefficient q and delivers the resulting input signal to a laser driver 205 for driving the exposure device 9. As a consequence, the potential of an electrostatic latent image formed on the surface of the photosensitive member 2 is changed such that the electrostatic latent image can be developed by an appropriate amount of toner, which makes it possible to stably control output image density.

Figure 17:
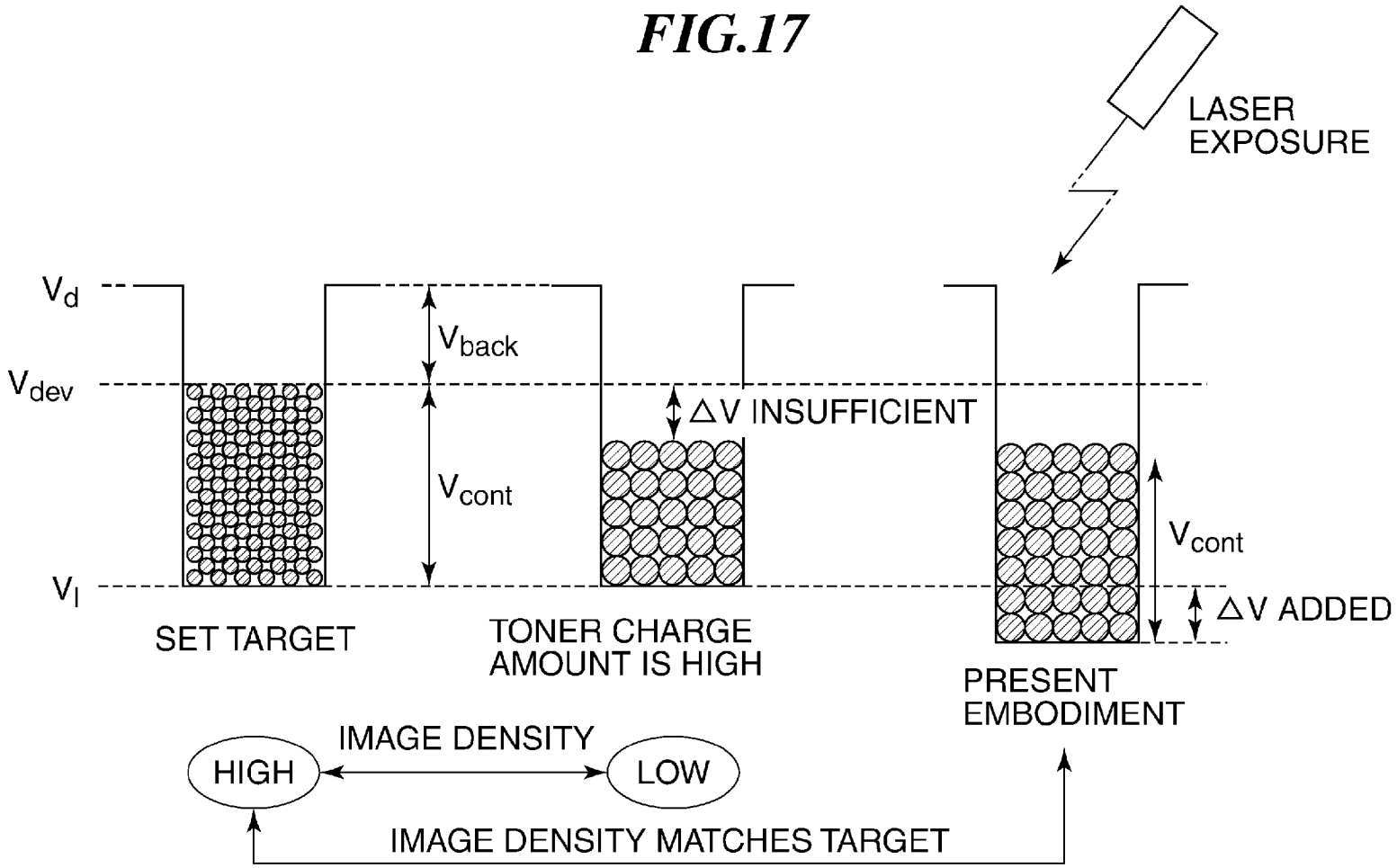
FIG. 17 is a diagram schematically showing a gradation correction method by an image forming apparatus according to a third embodiment of the present invention.
Figure 18A:
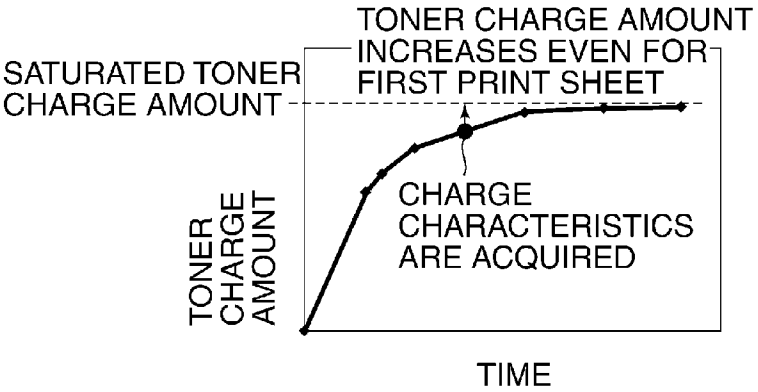
FIG.18A RELATED ART
FIGS. 18A to 18D are diagrams schematically showing charge-development characteristics of an image forming apparatus of the related art which performs image formation using electrophotography.
Figure 18B:
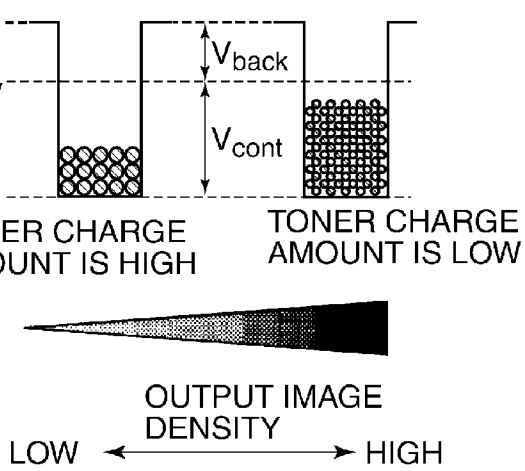
FIG.18B RELATED ART
Figure 18C:
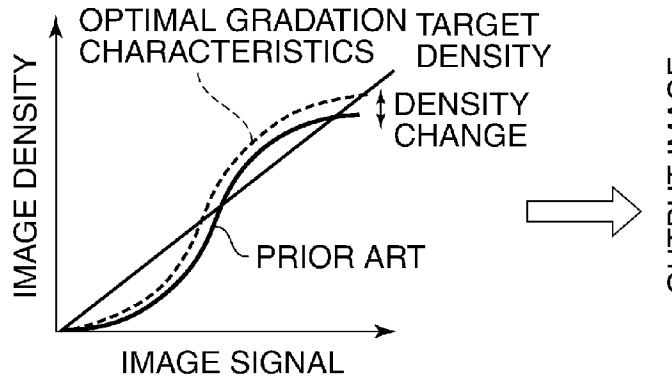
FIG.18C RELATED ART
Figure 18D:
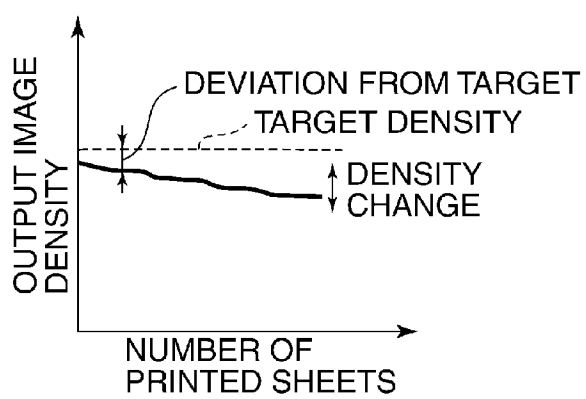
FIG.18D RELATED ART

FIG. 17 is a diagram schematically showing the above-described gradation correction method employed in the third embodiment. Note that potentials, such as Vdev, appearing on the vertical axis in FIG. 17, are the same as those appearing in FIGS. 18A to 18D. FIG. 17 illustrates an exemplary case in which when the toner charge amount is high, the potential of an exposed area is lowered to increase the amount of toner required for development so as to prevent reduction of output image density from being caused by development of an electrostatic latent image by a reduced amount of toner particles, whereby a toner amount is ensured which enables a target density to be obtained.

The present invention is not limited to the above-described embodiments. For example, insofar as an image forming apparatus is equipped with units and sequences for detecting the charge-development characteristics of developer, as the core of the present invention, the image forming apparatus may be different in construction from the above-described image forming apparatus.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2010-205641 filed Sep. 14, 2010, which is hereby incorporated by reference herein in its entirety.

What is claimed is:

1. An image forming apparatus comprising:

an image bearing member configured to have an electrostatic latent image formed on a surface thereof based on an image signal;

a developing unit configured to develop the electrostatic latent image on the image bearing member by using toner to thereby form a patch image;

a detection unit configured to detect a density of the patch image;

a predicting unit configured to calculate a toner charge amount from the density detected by the detection unit and predict a change in the toner charge amount based on a plurality of results of the calculation of the toner charge amount;

a generation unit configured to form a gradation correction table for use in correcting a relationship between the image signal and the density based on the change in the toner charge amount, predicted by the predicting unit; and a calculation unit configured to calculate a value of change of temperature of the developing unit, wherein the predicting unit is configured to calculate the toner charge amount from the density detected by the detection unit and generate a rising prediction equation for the toner charge amount, wherein the generation unit is configured to generate the gradation correction table for use in correcting the relationship between the image signal and the density, using the rising prediction equation, and wherein when the value of change of temperature is not smaller than a predetermined value, the predicting unit is configured not to generate the rising prediction equation for the toner charge amount.

2. An image forming apparatus comprising:

a correcting unit configured to correct image data using a gradation correction table;

an image forming unit having:

an image bearing member, an exposure device configured to expose, for forming an electrostatic latent image, the image bearing member based on the corrected image data, and a developing unit configured to develop the electrostatic latent image on the image bearing member by using toner, the image forming unit being configured to form an image and a plurality of patch images on the image bearing member;

a detection unit configured to detect a density of the plurality of patch images formed by the image forming unit at different timings;

a creating unit configured to calculate a toner charge amount from the density detected by the detection unit and create a rising prediction equation indicating a function of time, based on a plurality of the calculated toner charge amount;

a generation unit configured to generate the gradation correction table based on the rising prediction equation, created by the creating unit; and a calculation unit configured to calculate a value of change of temperature of the developing unit, wherein when the value of change of temperature is not smaller than a predetermined value, the creating unit is configured not to create the rising prediction equation for the toner charge amount.

3. The image forming apparatus according to claim 2, wherein the detection unit is configured to detect the density of the plurality of the patch images before a rising time constant of the toner charge amount has elapsed after the developing unit has started operation.

4. The image forming apparatus according to claim 3, wherein the rising time constant of the toner charge amount is a time period required for the toner charge amount to reach 63% of a saturated toner charge amount.

5. The image forming apparatus according to claim 2, wherein the image forming unit further comprises:

a transfer unit configured to transfer the image formed on the image bearing member onto a print sheet, and a fixing unit configured to fix the image transferred on the print sheet, onto the print sheet, and wherein after the fixing unit is started, the detection unit detects an image density of the plurality of the patch images before internal temperature of the developing unit has sharply risen due to the start of the fixing unit.

6. The image forming apparatus according to claim 2, wherein the creating unit is configured to calculate the saturated toner charge amount and a rising time constant by substituting a toner charge amount represented by $Y_1$, which corresponds to a rotation time period represented by $t_1$, and a toner charge amount represented by $Y_2$, which corresponds to a rotation time period represented by $t_2$, into following equations:

$$P=In((Y_1-Y_2)/(e^{-t2}-e^{-t1}))$$

$$A=(1-e^{-Pt1})/Y_1$$

$$\tau=1/P$$

wherein A represents the saturated toner charge amount and $\tau$ represents the rising time constant.

7. The image forming apparatus according to claim 6, wherein the creating unit is configured to create the rising prediction equation for the toner charge amount represented by Y which corresponds to a rotation time period, represented by t, of the developing unit by substituting A which represents the saturated toner charge amount, and $\tau$ which represents the rising time constant, into the following equation:

$$Y=A(1-e^{-Pt}).$$

8. The image forming apparatus according to claim 2, wherein the creating unit is configured to create the rising prediction equation based on the plurality of the calculated toner charge amount and a rotation time period of the developing unit.

* * * * *